United States Patent [19]

Elmore

[11] Patent Number: 5,013,045

[45] Date of Patent: May 7, 1991

[54] GOLF CLUB SWING EXERCISING AND TRAINING APPARATUS AND METHOD

[76] Inventor: Rex Elmore, 4408 Long Champ Dr., Austin, Tex. 78746

[21] Appl. No.: 529,247

[22] Filed: May 25, 1990

[51] Int. Cl.[5] ..... A63B 69/36

[52] U.S. Cl. ..... 273/186 R; 273/191 B

[58] Field of Search ..... 273/186 R, 186 A, 35 R, 273/183 R, 183 B, 188 R, 191 R, 191 B, 193 A, 193 B, 194 B

[56] References Cited

U.S. PATENT DOCUMENTS

| | | | |
|---|---|---|---|
| 2,655,378 | 10/1953 | Sheffer | 273/191 B |
| 2,858,133 | 10/1958 | Self | 273/186 R |
| 4,353,556 | 10/1982 | Self et al. | 273/186 A |
| 4,944,518 | 7/1990 | Flynn | 273/186 X |

*Primary Examiner*—William H. Grieb

*Attorney, Agent, or Firm*—J. Nevin Shaffer, Jr.; Russell D. Culbertson

[57] ABSTRACT

A device for exercising and training various golf swings or strokes includes an elongated tension member with a connector adapted to securely but releasably connect a club end of the tension member to the golf club shaft at an exercising point substantially above the club head. The exercising point is preferably the club balance point for exercising and training the putting stroke, and a point just below the grip for exercising a full swing. When connected between the surface and the exercising point, the tension member is adapted to supply an exercising force at the exercising point as the club is swung. Two elongated tension members connected in a line forwardly and rearwardly from the club may be used to provide an exercising force on both the backswing and the follow-through.

16 Claims, 3 Drawing Sheets

GOLF CLUB SWING EXERCISING AND TRAINING APPARATUS AND METHOD

BACKGROUND OF THE INVENTION

This invention relates to devices for developing a proper golf swing, and more particularly, to an apparatus and method for exercising and training both a putting stroke and a full swing.

It is important for a golfer to properly "warm up" before playing a round and to keep "warm" during a round in which play has been interrupted. Proper warm-up helps to improve scores and to reduce the risk of injury. Between rounds, particularly when playing infrequently, it is also helpful to continue to exercise and train the muscles used in making the various golf strokes.

One common method of speeding up the warm-up process and exercising the muscles used in making a full swing was to place a weight on the club and take a number of easy warm up swings. Extra weight was usually supplied by a "donut" of heavy material that slid onto the shaft and rested against the club head. Although the weighted "donut" was easily portable and could be used on the course or at home, the added weight near the club head changed the overall characteristics of the club being used and thus was not suited for developing a proper swing.

U.S. Pat. Nos. 4,353,556 and 2,858,133, both to Self, show devices specifically adapted for training a putting stroke. The '133 patent included an elongated base with an elongated elastic band attached at one end to one end of the base. The base was adapted to be fixed on a particular surface and a loop at the free end of the elastic band was adapted to slip onto the putter shaft just above the club head. One practiced and trained his or her putting stroke by simply making a normal stroke over the base member against the tension provided by the elastic band.

The '556 patent included a flexible alignment band adapted to be stretched between two points and secured to form a line, and either a single elastic tensioning band or two separate tensioning bands. Each tensioning band of the two tension band version included a loop adapted to slip onto the head of the putter and was also adapted to be secured at one of the end points of the alignment band. The tensioning band of the single band version included a single loop formed at its middle for slipping onto the putter head and connectors at each end for connecting to the end points of the alignment band. The elastic tensioning band or bands provided an exercising force on the head of the putter as one made a normal stroke along the alignment band. This exercising force along the alignment band helped exercise the muscles used in putting and helped train the muscles to develop the putting stroke.

There were, however, several problems with the devices shown in the '556 and '133 patents. The device shown in the '133 patent was not easily portable due to the elongated base member, and could not be used on the golf course. Also, the exercising force produced by the elastic band was applied just above the club head and caused an excessive pivoting force tending to pivot the club in the user's hands as the stroke was made. Similarly, the loop connection shown in the '556 patent required that the force be applied either just above the club head or actually on the club head. This latter connection not only caused the pivoting movement at the hands, but also tended to rotate the club shaft about its longitudinal axis as the stroke was made. Also, none of the devices disclosed in these patents were suited for exercising and training a full swing. It is therefore an object of the invention to provide a golf swing exercising and training apparatus and method adapted to overcome the problems discussed above and others associated with exercising and training the muscles used in making a golf swing or stroke.

SUMMARY OF THE INVENTION

A golf swing exercising and training apparatus according to the invention includes an elongated tension member having an anchor device connected to one end and shaft connecting means connected to the other end. The anchor device is adapted to secure one end of the tension member to a surface while the shaft connecting means is adapted to connect the opposite end of the tension member to an exercising point on the club shaft substantially above the club head. When a golfer takes a swing or putting stroke with the tension member properly connected between the surface on which he or she is standing and the exercising point on the club shaft, the tension member provides an exercising force that increases resistance to the movement required by the swing or stroke. This resistance not only strengthens the muscles used in the swing or stroke but also builds in a "muscle memory" that enables one to make the proper stroke or swing more consistently.

According to the invention, the exercising point is a point on the shaft substantially above the club head. For example, when exercising and training the putting stroke, the exercising point is preferably the club balance point or center of gravity. The preferred exercising point for a full swing is a point just below the grip of the club. In either case, the tension member provides a substantial downward force component and thus the shaft connecting means is adapted for a non-slip connection that does not allow the tension member to slide along the club shaft in response to the downward force component.

The tension member connection at the balance point for exercising the putting stroke reduces the forward or rearward pivoting at the hands encountered in prior putt training devices. Furthermore, this balance point connection eliminates any tendency of the club to rotate in the hands as the stroke is practiced. Also, the downward force component of the exercising force trains one to keep the club head down through the ball in the proper manner and down through the follow through. The prior putt training devices were incapable of providing this downwardly directed training force. With regard to the full swing, the preferred connection on the shaft just below the grip applies the exercising and training force without distorting the swing and without interfering with the normal feel of the club.

In one form of the invention, the apparatus includes two separate tension members, each with its own separate anchor member and connecting means. In this form of the invention, the two tension members may be anchored so as to form a line extending forwardly and rearwardly from the club shaft in position to apply exercising forces on both the backswing and the follow-through. Another form of the invention includes first and second tension members that are each adapted to be connected to a club shaft at a desired exercising point with a common connecting means.

The connecting means preferably comprises a gripping portion adapted to releasably grip the club shaft at the desired exercising point, tightening means for tightening the gripping portion to a non-slip gripping position. and a tension member connector for receiving and securing the club end of the tension member. In one preferred form of the invention the gripping portion includes first and second gripping jaws covered with a resilient grip covering material to help provide a non-slip grip between the jaws and the club shaft. In this form of the invention the tightening means may comprise a spring adapted to bias the first and second gripping jaws to the desired gripping position about the club shaft. Alternatively, the gripping portion may comprise an open or adjustable ring of material having first and second ring ends and adapted to be slipped on the club shaft at the desired exercising point and then tightened to provide a non-slip grip. In this form of the invention the tightening means may comprise a toothed member connected to one ring end and a correspondingly toothed slot member connected to the opposite ring end and adapted to receive the toothed member in a connecting position. In either embodiment, the tension member connector or connectors may be any suitable arrangement for securely receiving the club end of the tension member or members without interfering with the grip of the connecting means on the club shaft.

The method of the invention includes first connecting the club end of a first tension member to the golf club shaft at the desired exercising point substantially above the head of the golf club, and securing the anchor end of the first tension member to the surface on which the user is to stand to practice the swing or stroke. With the anchor end anchored and the club end of the tension member connected to the golf club shaft at the exercising point, the method next includes positioning the golf club in a starting position in which substantially all slack is removed from the first tension member. The method then includes providing a first exercising force at the exercising point with the first tension member by moving the club to a position beyond the starting position from the anchor point of the first tension member.

Where both the backswing and follow-through are to be exercised, the method also includes connecting a club end of a second tension member to the shaft at the exercising point and temporarily securing the anchor end of the second tension member to the surface with substantially all slack removed from the second tension member and with the first and second tension members following along a single line along the surface. The second exercising force is then produced by moving the golf club beyond the neutral point from the anchor end of the second tension member.

As discussed above, the preferred exercising point for exercising and training the putting stroke is the club balance point or center of gravity. In order to ensure that the connectors are positioned correctly on the club shaft the method of the invention also includes marking the club balance point with a suitable marker, such as a piece of tape, prior to connecting the tension members.

These and other objects, advantages, and features of the invention will be apparent from the following description of the preferred embodiments, considered along with the accompanying drawings.

DESCRIPTION OF THE PREFERRED EMBODIMENTS

Figure 1:
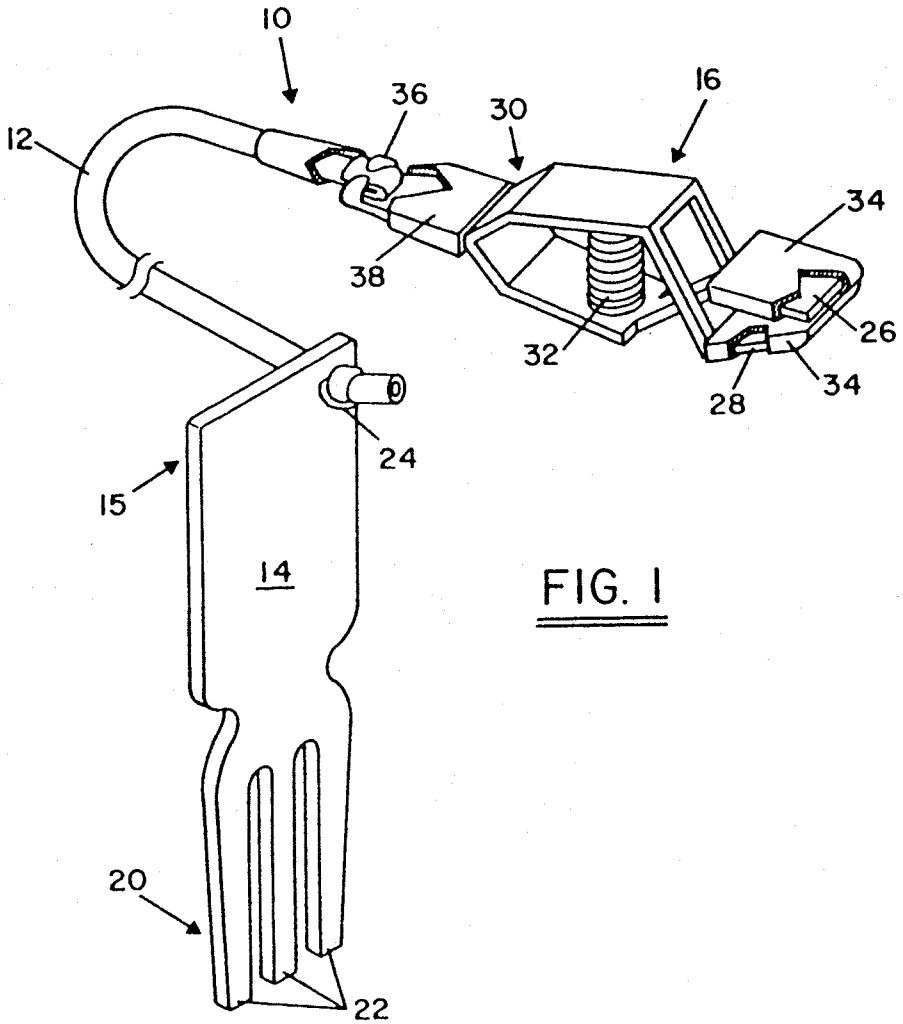
FIG. 1 is a view in perspective of a golf swing exercising and training apparatus embodying the principles of the invention.

Referring to FIG. 1, a golf swing exercising and training apparatus 10 embodying the principles of the invention includes a tension member 12, an anchor member 14, and connecting means generally indicated at reference numeral 16. The tension member 12 comprises an elongated piece of elastic material having a club end to which the connecting means 16 is connected and an anchor end to which the anchor member 14 is connected, and is adapted to produce an exercising force when stretched longitudinally. Although, the tension member 12 may have any suitable shape, the preferred illustrated tension member comprises a tube of elastic material.

The illustrated anchor member 14 comprises an elongated piece of rigid material including a tension member connection end 18 and anchoring end 20. The anchoring end includes a series of prongs 22, and is adapted to be inserted to turf or soil at a desired anchor point in order to hold the anchor end of the tension member 12 at the anchor point. The illustrated anchor member 14 also includes a connecting hole 24 at its connecting end 18 for receiving the anchor end of the tension member 12. A knot is tied in the tension member material to secure the anchor end of the tension member in the connecting hole 24. Although the illustrated anchor member 14 is preferred for its simplicity and utility as a divot repairing tool, a number of alternatives are possible including different shaped members and members or devices adapted to connect to some fixed object that forms the desired anchor point.

The connecting means 16 shown in FIG. 1 is adapted to connect the club end of the tension member 12 securely but releasably to the shaft of a golf club (not shown in FIG. 1) at a desired exercising point. The connecting means 16 comprises a gripping portion adapted to grip the club shaft, tightening means for maintaining the gripping portion in a desired gripping position about the club shaft, and a tension member connector for connecting to the club end of the tension member 12. In the alligator clip-type connecting means shown in FIG. 1, the gripping portion comprising first and second gripping jaws 26 and 28, respectively, adapted to close together to securely grip the golf club shaft. The two gripping jaws 26 and 28 are pivotally connected by a suitable connection 30 at one end and are biased together in a gripping position with a suitable biasing spring 32 which forms the tightening means in this form of the invention. The preferred gripping jaws 26 and 28 are formed from a suitable strong rigid material and preferably include a suitable resilient grip covering material 34 for helping provide the desired non-slip grip on the club shaft. The tension member connector may include any suitable means for connecting to the club end of the tension member 12, and preferably comprises a tension member receiving structure 36 adapted to receive the club end of the tension member and then be crimped against the tension member material to secure the material in place. A protective covering 38 may also be provided over the connector for protecting the particular tension member connection.

Figure 2:
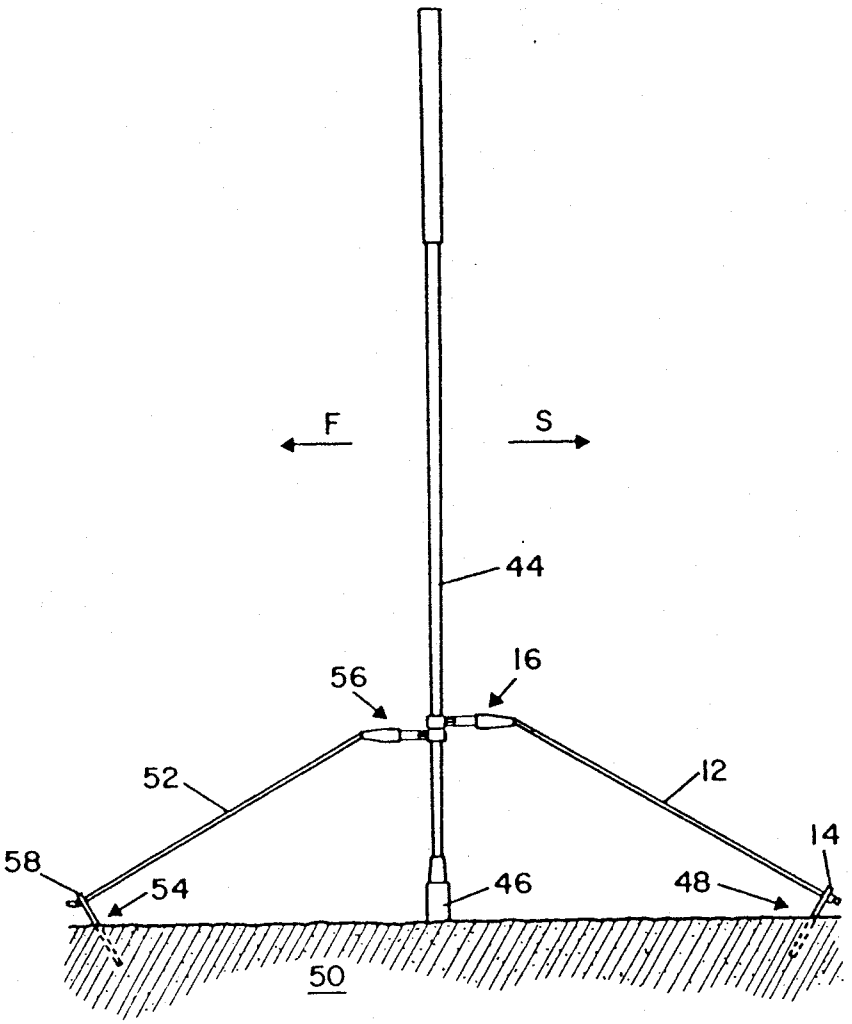
FIG. 2 is a view in front elevation and drawn to a reduced scale showing an exercising and training apparatus according to the invention connected to a putter for exercising and training the putting stroke.

Referring now to FIG. 2, the method of exercising and training a golf swing or stroke according to the invention includes first connecting the club end of the elongated tension member 12 to a golf club 44 at an exercising point on the club shaft substantially above the club head 46, and securing the anchor end of the tension member to a desired anchor point 48 on a suitable surface 50. In the illustrated form of the invention, the connection with the club shaft is provided by the alligator clip-type connecting means 16 while the connection at the anchor point is provided by driving the anchor member 14 into the surface 50. Once the desired connections are made, the club 44, shown in FIG. 2 as a putter, is positioned in a starting position in which substantially all slack is removed from the tension member 12. The method next includes producing a first exercising force by moving or swinging the club 44 away from the anchor point 48 in the direction indicated by arrow F in FIG. 2. It will readily be appreciated that the club starting position may be a point at which the tension member 12 is already stretched somewhat. In this case the tension member 12 actually provides the exercise force prior to the step of moving the club 44 further away from the anchor point 48.

A single tension member 12 with the connecting means 16 and anchor member 14 according to the invention provides an exercising and training force for either the backswing or follow-through of the particular stroke. As shown in FIG. 2, the preferred method of the invention includes connecting a club end of a second tension member 52 to the club 44 substantially at the exercising and training point on the club shaft, and securing an anchor end of the second tension member to a second anchor point 54 so that substantially all slack is removed from the second tension member and so that the second tension member is generally aligned with the other or first tension member 12. To make the desired connection to the golf club shaft and to the second anchor point 54, the second tension member 52 is connected to second connecting means 56 and a second anchor member 58 similar to the connecting means 16 and anchor member 14 shown in FIG. 1. With the second tension member 52 connected, the act of moving the club 44 in the direction indicated by arrow S in FIG. 2 stretches the second tension member so that it produces a second exercising force on the club. The two tension members 12 and 52 and their associated connecting means 16 and 56 and anchor members 14 and 58, respectively, provide an exercising and training force on both the backswing and follow-through of a particular golf swing or stroke. This exercising force can be increased or decreased on either the backswing or follow-through by moving the club starting point in the direction of arrow F or the direction indicated at arrow S.

As shown in FIG. 2, the preferred exercising point for training the putting stroke is the balance point or center of gravity of the putter. The balance point, which is substantially above the club head and varies from club to club, is preferably located and then marked with a piece of tape or other suitable material to act as a guide when connecting the tension members 12 and 52. Since the exercising point is substantially above the club head, each tension member 12 and 52 extends at a substantial angle to the surface 50, and provides an exercising force that includes both a horizontal force component and a vertical or downward force component. The downward force component produced by the tension members helps train the user to keep the club head 46 down through the stroke.

FIGS. 3 through 6 show an alternate form of the invention that includes first and second tension members 70 and 72, respectively, connected to a single connector or connecting means 74 adapted to connect both tension members to a golf club 76 at a desired exercising point on the club shaft substantially above the club head 78. Each tension member 70 and 72 is similar to the tension member 12 in FIG. 1 and includes a club end connected to the connecting means 74 and an anchor end connected to an anchor member 80 and 82, respectively. The anchor members 80 and 82 each comprise an elongated body with an opening 84 and 85, respectively, at one end through which the anchor end of the respective tension member may be received and then tied in a knot similarly to the embodiment shown in FIG. 1.

Figure 4:
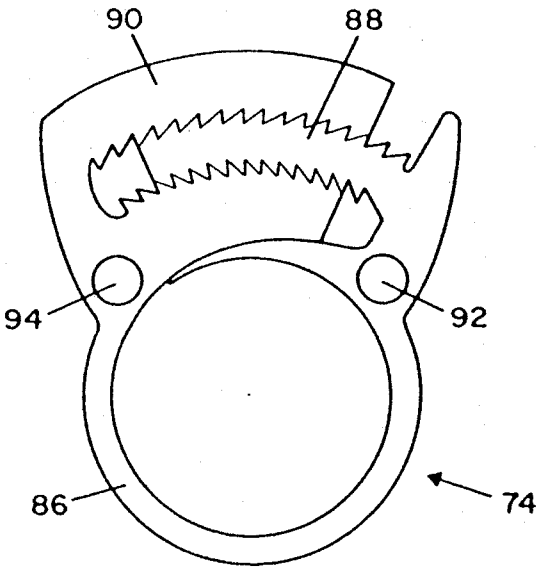
FIG. 4 is a top plan view showing the preferred connecting means used in the embodiment shown in FIG. 3.
Figure 3:
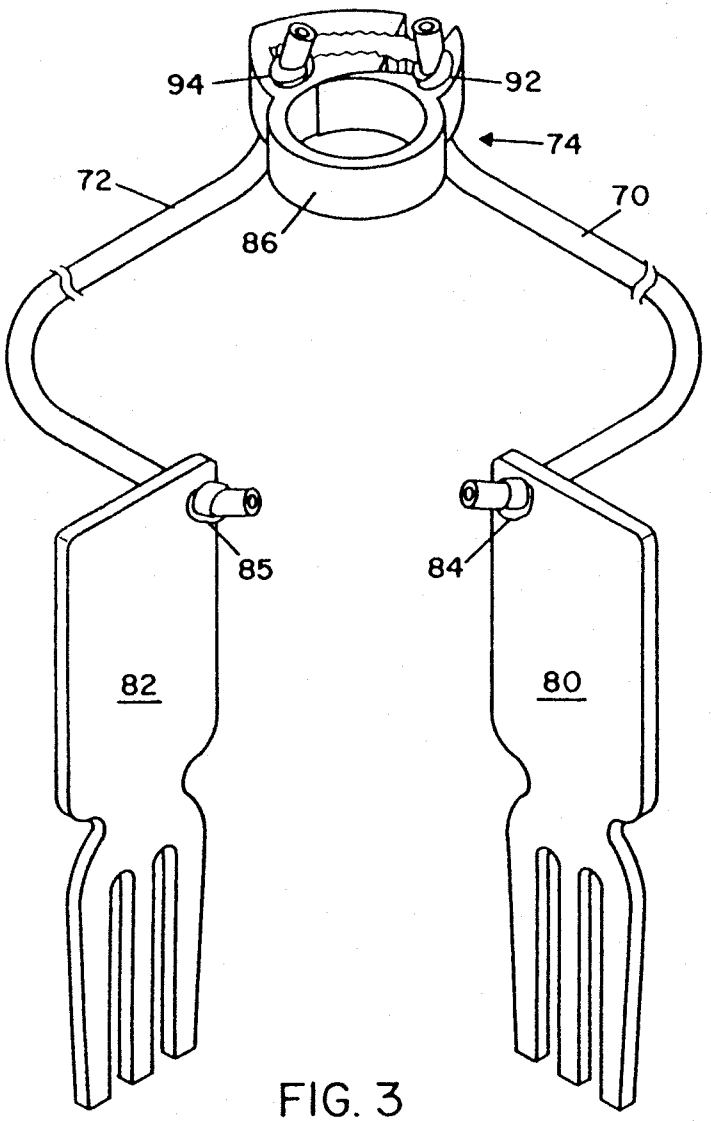
FIG. 3 is a view in perspective of an alternate golf swing exercising and training apparatus embodying the principles of the invention.

Referring particularly to FIG. 4, the alternate connecting means 74 includes a gripping portion comprising an open ring 86 of somewhat flexible material adapted to be tightened around the club shaft to form a secure non-slip connection. The tightening means in this alternate form of the invention comprises a ring closure assembly including a toothed member 88 connected to a first end of the ring 86, and a correspondingly toothed slot member 90 connected to the opposite end of the ring member. The toothed member 88 is adapted to be inserted into the toothed slot 90 with the corresponding teeth acting to lock the two ring ends together in a desired tightened position. Each tension member 70 and 72 is connected to the ring-type connecting means 74 through an opening 92 and 94, respectively, in the ring material. The connection is made by inserting the club end of the particular tension member and then tying a knot to prevent the club end from slipping back through the opening.

Figure 6:
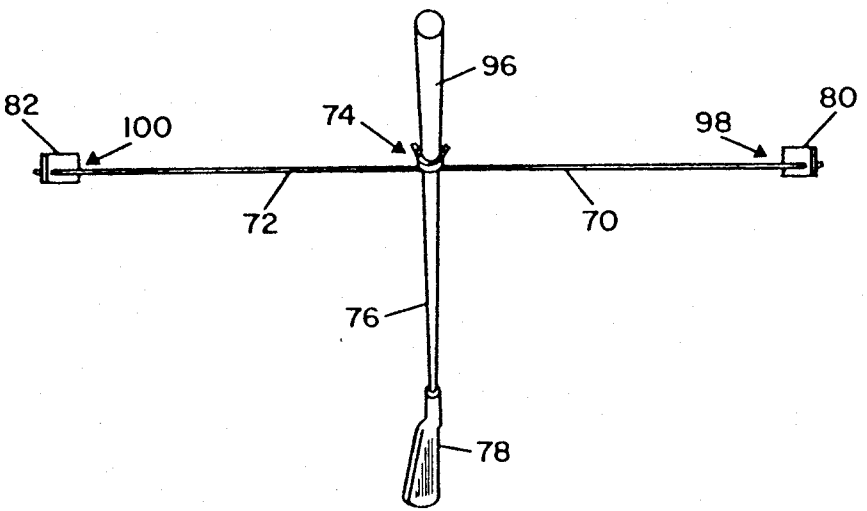
FIG. 6 is a top plan view drawn to a reduced scale similarly to FIG. 5 and showing the apparatus of FIG. 3 connecting to a golf club.
Figure 5:
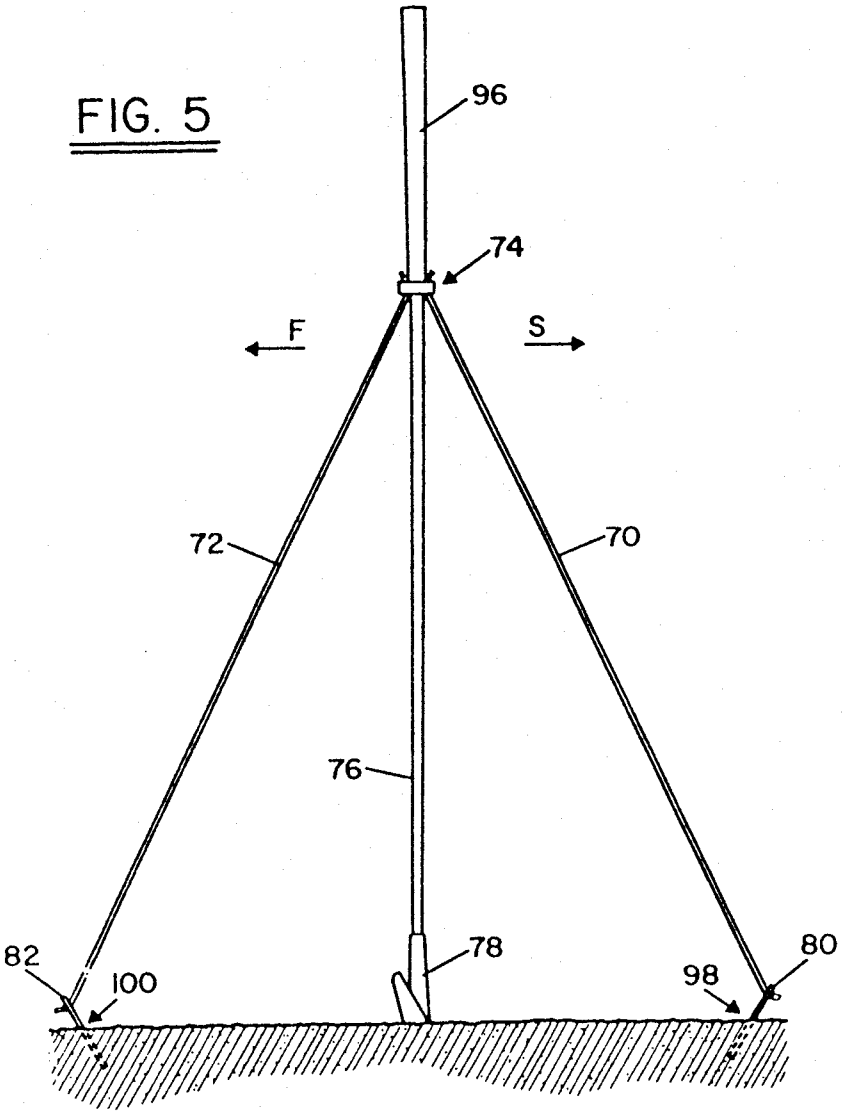
FIG. 5 is a view in front elevation drawn to a reduced scale and showing the apparatus shown in FIG. 3 connected to a golf club to provide an exercising and training force according to the invention.

Referring particularly to FIGS. 5 and 6, the ring-type connecting means 74 is adapted to connect both first and second tension members 70 and 72, respectively, to the golf club 76 at a desired exercising point on the club shaft. For exercising and training a full swing, the preferred exercising point is a point on the club shaft just below the grip 96. With the two tension members 70 and 72 anchored to first and second anchor points 98 and 100 similarly to the method described with reference to FIG. 2, the first tension member 70 is adapted to provide an exercising and training force as the club 76 is moved in the direction of arrow F while the second tension member 72 is adapted to provide a second exercising force as the club is moved in the direction of arrow S. Thus, both the backswing and follow-through may be exercised.

The above described preferred embodiments are intended to illustrate the principles of the invention, but not to limit the scope of the invention. Various other embodiments and modifications to these preferred embodiments may be made by those skilled in the art without departing from the scope of the following claims. For example, the connecting means for connecting the club end of the tension member or members to the club may be any type of connector adapted to provide a secure non-slip grip at any desired exercising point along the club shaft. Also, the anchor means may comprise any suitable device for securely anchoring the anchor end of the tension member to a desired surface so that the tension member is stretched to provide the exercising force as the particular golf swing or stroke is performed.

I claim:

1. A golf club swing exercising and training apparatus comprising:

(a) a first elongated tension member made of an elastic material and having an anchor end and a club end, the first tension member being adapted for providing a first exercising force as it is stretched longitudinally;

(b) first anchor means secured to the anchor end of the first tension member for temporarily securing the anchor end of the first tension member to a desired surface at a desired first anchor point; and (c) first connecting means secured to the club end of the first tension member for releasably securing the club end of the first tension member to the shaft of a golf club at an exercising point located at substantially any position on the shaft above the club head so that the first exercising force may be transferred to the exercising point of the club shaft when the first tension member is stretched between the exercising point and the first anchor point.

2. The apparatus of claim 1 wherein the first connecting means includes:

(a) a gripping portion for gripping the golf club shaft;

(b) tightening means for maintaining the gripping portion in a desired gripping position about the golf club shaft at the exercising point so that the gripping portion may not slide along the club shaft; and (c) a tension member connector connected to the club shaft gripping portion by which the club end of the first tension member may be secured to the gripping portion.

3. The apparatus of claim 2 wherein the gripping portion includes:

(a) first and second gripping jaws adapted to securely grip the golf club shaft.

4. The apparatus of claim 3 wherein the first and second gripping jaws include a resilient grip covering material to help provide a secure, non-slip grip between the gripping jaws and the golf club shaft.

5. The apparatus of claim 4 wherein the tightening means includes:

(a) a jaw biasing spring adapted to bias the first and second gripping jaws together in a club shaft gripping position.

6. The apparatus of claim 5 wherein the exercising point is the club balance point.

7. The apparatus of claim 1 further comprising:

(a) a second elongated tension member made of an elastic material and having an anchor end and a club end, the second tension member being adapted for providing a second exercising force as it is stretched longitudinally;

(b) second anchor means secured to the anchor end of the second tension member for temporarily securing the anchor end of the second tension member to a desired surface at a desired second anchor point; and (c) second connecting means secured to the club end of the first tension member for releasably securing the club end of the second tension member to the shaft of the golf club at approximately the exercising point so that the second exercising force may be transferred to the exercising point on the club shaft when the second tension member is stretched between the exercising point and the second anchor point.

8. The apparatus of claim 1 further including:

(a) a second elongated tension member made of an elastic material and having an anchor end and a club end, the second tension member being adapted for providing a second exercising force as it is stretched longitudinally;

(b) second anchor means secured to the anchor end of the second tension member for temporarily securing the anchor end of the second tension member to a desired surface at a desired second anchor point; and (c) wherein the club end of the second tension member is secured to the first connecting means and the first connecting means is adapted for releasably securing the club end of the second tension member to the golf club shaft at the exercising point so that the second exercising force may be transferred to the exercising point when the second tension member is stretched between the exercising point and the second anchor point.

9. The apparatus of claim 8 wherein the connecting means includes:

(a) a gripping portion for gripping the golf club shaft;

(b) tightening means for maintaining the gripping portion in a desired gripping position about the golf club shaft so that the gripping portion may not slide substantially along the club shaft;

(c) tension member connecting means associated with the gripping portion by which the club end of both the first and second tension members may be secured to the gripping portion.

10. The apparatus of claim 9 wherein the gripping portion comprises:

(a) a ring of material having first and second ring ends; and (b) a ring closure assembly adapted to hold the first and second ring ends together in a desired gripping position so that the ring of material securely grips the golf club shaft at the exercising point.

11. The apparatus of claim 10 wherein the closure assembly includes:

(a) a toothed member connected to the first ring end; and (b) a correspondingly toothed slot member connected to the second ring end adapted to receive the toothed member so as to connect the first and second ring ends in the desired gripping position.

12. The apparatus of claim 11 wherein the exercising point is a position on the club shaft immediately below the grip of the club.

13. A golf club swing exercising and training method comprising of the steps of:

(a) connecting a club end of a first elongated and elastic tension member to the shaft of a golf club at an exercising point at or above the balance point of the golf club;

(b) temporarily securing an anchor end of the first tension member to a suitable surface;

(c) positioning the golf club in a starting position in which substantially all slack is removed from the first tension member; and (d) producing a first exercising force at the exercising point with the first tension member by moving the club to a position beyond the starting position from the anchor end of the first tension member.

14. The method of claim 13 including the step of:

(a) marking the club balance point with a suitable marker prior to connecting the first tension member to the golf club.

15. The method of claim 13 further comprising the steps of:

(a) connecting a club end of a second elongated and elastic tension member to the shaft of the golf club at the exercising point;

(b) temporarily securing an anchor end of the second tension member to the surface so that substantially all slack is removed from the second tension member when the club is in the starting position and the first and second tension members are generally aligned; and (c) producing a second exercising force at the exercising point with the second tension member by moving the club to a position beyond the starting position from the anchor end of the second tension member.

16. The method of claim 15 wherein the exercising point is a point on the golf club shaft just below the grip.

* * * * *